US011668539B1

(12) United States Patent
Randazzo et al.

(10) Patent No.: US 11,668,539 B1
(45) Date of Patent: Jun. 6, 2023

(54) SUB-SONIC HIGH PRECISION FIREARM BARREL

(71) Applicants: Robert S. Randazzo, Frankfort, DE (US); Michael Allyn Miller, Tenino, WA (US); Richard Brady Olsen, Rainier, WA (US)

(72) Inventors: Robert S. Randazzo, Frankfort, DE (US); Michael Allyn Miller, Tenino, WA (US); Richard Brady Olsen, Rainier, WA (US)

( * ) Notice: Subject to any disclaimer, the term of this patent is extended or adjusted under 35 U.S.C. 154(b) by 0 days.

(21) Appl. No.: 17/563,076

(22) Filed: Dec. 28, 2021

(51) Int. Cl.
*F41A 21/18* (2006.01)

(52) U.S. Cl.
CPC ..... *F41A 21/18* (2013.01)

(58) Field of Classification Search
CPC ..... F41A 21/18
USPC ..... 42/78; 89/14.7
See application file for complete search history.

(56) References Cited

U.S. PATENT DOCUMENTS

| | | | | |
|---|---|---|---|---|
| 2,293,114 A * | 8/1942 | Carter | F41A 21/18 | 89/14.05 |
| 2,967,369 A * | 1/1961 | Walton | F42B 14/02 | 42/78 |
| 3,100,358 A | 8/1963 | Robinson | | |
| 4,660,312 A * | 4/1987 | A'Costa | F41A 21/16 | 42/76.01 |
| 6,070,532 A * | 6/2000 | Halverson | F42B 14/02 | 102/501 |
| 11,280,599 B2 * | 3/2022 | Billings | F42B 14/02 | |

* cited by examiner

*Primary Examiner* — Bret Hayes
(74) *Attorney, Agent, or Firm* — E J Asbury III, LLC

(57) ABSTRACT

A barrel for use in a firearm optimized to fire subsonic ammunition with high precision. The barrel groove diameter being within .0003 inch of the nominal bullet diameter and the barrel has at least 8 rifled grooves. Each of the plurality of rifling grooves has a sidewall formed from the bore diameter to the groove diameter, wherein the sidewalls formed are substantially parallel and the depth of each of the rifling grooves is shallow. The bullet is obturated as the bullet is forced down the bore. The plurality of shallow barrel grooves forming a plurality of raised lands upon the bullet. The obturated bullet having at least 50% lands formed around the circumference of the bullet body. The buffeting effect upon the bullet in flight by a transition shock wave upon the raised bullet lands is reduced by the plurality of bullet lands and the reduced height of each of the plurality of bullet lands.

4 Claims, 8 Drawing Sheets

-- PRIOR ART --

-- PRIOR ART --

-- PRIOR ART --

-- Prior Art --

-- Prior Art --

-- PRIOR ART --

SUB-SONIC HIGH PRECISION FIREARM BARREL

BACKGROUND OF THE INVENTION

1. Field of the Invention

The present invention relates generally to rifled barrels for firearms. Particularly the present invention relates to firearm barrels which may fire subsonic ammunition with high flight trajectory precision.

2. Description of the Related Art

The term accuracy is often used when referring to firearms. A less used but far more important term is precision. As defined herein, precision is the repeatability of a given process. As defined herein, accuracy is the closeness of the result of the process to the desired result. In reference to firearms, the repeatability of the impact point of a bullet upon a target at a given distance is of utmost importance. The impact point repeatability is most affected by the precision of the flight trajectory of the bullet. A precise flight trajectory requires the bullet fly in a consistent and repeatable arc thru the atmosphere with little deviation from shot to shot. With a precise i.e. repeatable flight trajectory, the sights of the firearm may be adjusted to achieve the desired accuracy of the impact point upon the target. Stated another way, a firearm may fire a bullet with a given flight trajectory precision and then the firearm sights adjusted to achieve the best accuracy upon the target which that flight trajectory precision allows.

In many firearm and cartridge combinations, the bullet exits the barrel at a super-sonic velocity, in some excess of the speed of sound. In flight, drag upon the bullet may slow the round to a sub-sonic velocity prior to impacting the intended target. In many situations within the firearm community, a sub-sonic bullet is preferred. In these cartridges and firearm combinations, the cartridge powder charge and barrel combination results in the bullet leaving the muzzle of the barrel at a sub-sonic velocity. In the atmosphere on a standard day at sea level static conditions, the speed of sound is approximately 1,100-1,125 feet per second. As will be appreciated by those skilled in the art, the speed of sound varies with height, temperature, humidity, and other secondary factors. A cartridge powder charge may be designed for any given firearm such that the bullet exits the barrel at a velocity below 1,100 feet per second. As defined herein, the term firearm includes both rifles and pistols with any barrel length and cartridge combination.

Achieving flight trajectory precision with a sub-sonic bullet has proven difficult with many firearms. The lack or precision of the flight trajectory results in an unacceptable scatter of the flight paths of the bullets and ultimately a scatter in the impact point upon the target from shot to shot. Stated another way, there is poor repeatability in the sub-sonic bullet flight trajectory or path from a given firearm from shot to shot. Of paramount importance to the precision of the sub-sonic bullet flight trajectory is the firearm barrel design. The slow forward velocity of the bullet means that any mass imbalance or streamlining imbalance of the body of the bullet effectively has a longer period of time to disturb the bullet flight trajectory at any given range. The relatively slow rotation of the sub-sonic bullet also reduces the gyroscopic effect of the spinning bullet, making any asymmetric weight distribution within the fired and obturated bullet more apparent. The symmetry in the obturated bullet body and lands swaged upon the bullet body are of critical importance to the precision of the bullet flight trajectory.

According, it would be advantageous to provide a barrel design to optimize the flight trajectory precision of a sub-sonic round from a firearm. The barrel design would uniformly obturate the sub-sonic fired bullet. The base of the fired bullet and the lands formed thereon would be uniform to allow for precision flight characteristics of each sub-sonic bullet fired. The groove design of the barrel would provide lands which optimize the trans-sonic and sub-sonic bullet flight trajectory precision within the barrel and exiting the barrel. In flight, the lands formed upon the bullet by the barrel design would optimize the precision of the bullet flight trajectory in both the sub-sonic and transonic flight regimes. It is thus to such a sub-sonic high precision firearm barrel that the present invention is primarily directed.

SUMMARY OF THE INVENTION

The disadvantages of the prior art are overcome by the present invention which, in one aspect, is a barrel for use in a firearm. The barrel has a central axis and a central bore formed around the central axis. The central bore has a bore diameter. The barrel has a chamber for receiving a cartridge therein, the chamber configured to receive a cylindrical cartridge case with a bullet engaged within the cartridge case. The bullet has a nominal bullet diameter, and the cartridge case containing a propellant, the propellant producing a propellant pressure upon ignition of the propellant. The barrel has a plurality of rifling grooves within the bore, the outer diameter of the grooves defining a groove diameter, the groove diameter being within .0003 inch of the nominal bullet diameter and the barrel has at least 10 rifled grooves. Each of the plurality of rifling grooves has a sidewall formed from the bore diameter to the groove diameter, wherein the sidewalls formed are substantially parallel and the depth of each of the rifling grooves is shallow. Wherein the rifled grooves have a twist angle to spin the bullet as it is forced down the bore, the twist angle formed between the groove and the central axis of the bore. The groove twist angle imparting a twist rate upon the bullet. Upon ignition of the propellant, the bullet is forced by propellant pressure out of the cartridge case and into the rifled bore of the barrel. The propellant pressure then forcing the bullet out the end of the barrel at a subsonic velocity.

The bullet being obturated as it is forced down the bore, the plurality of shallow barrel grooves forming a plurality of raised lands upon the bullet. The obturated bullet having at least 50% lands formed around the circumference of the bullet body. Wherein the buffeting effect upon the bullet in flight by a normal shock wave upon the raised bullet lands is reduced by the plurality of bullet lands and the reduced height of each of the plurality of bullet lands.

In another aspect of the present invention, the driven edge of the bullet land is 90 to 95 degrees to the reference edge and the trailing edge of the bullet land is between 0 and 20 degrees to the reference edge. The buffeting effect upon the bullet in flight by turbulence across the trailing edge bullet land is reduced.

In yet another aspect of the present invention, the buffeting effect of the propellant pressure upon the bullet from an imperfection in any one rifling groove is reduced by at least 50% and the buffeting of the bullet as the bullet exits the barrel and transitions to flight is reduced. In yet another aspect of the present invention, as the bullet is forced down the barrel bore, the sealing of the propellant pressure behind the bullet and between the bullet and barrel bore is improved by the plurality of shallow rifling grooves.

These and other aspects of the invention will become apparent from the following description of the preferred embodiments taken in conjunction with the following drawings. As would be obvious to one skilled in the art, many variations and modifications of the invention may be affected without departing from the spirit and scope of the novel concepts of the disclosure.

DETAILED DESCRIPTION OF THE INVENTION

Figure 1:
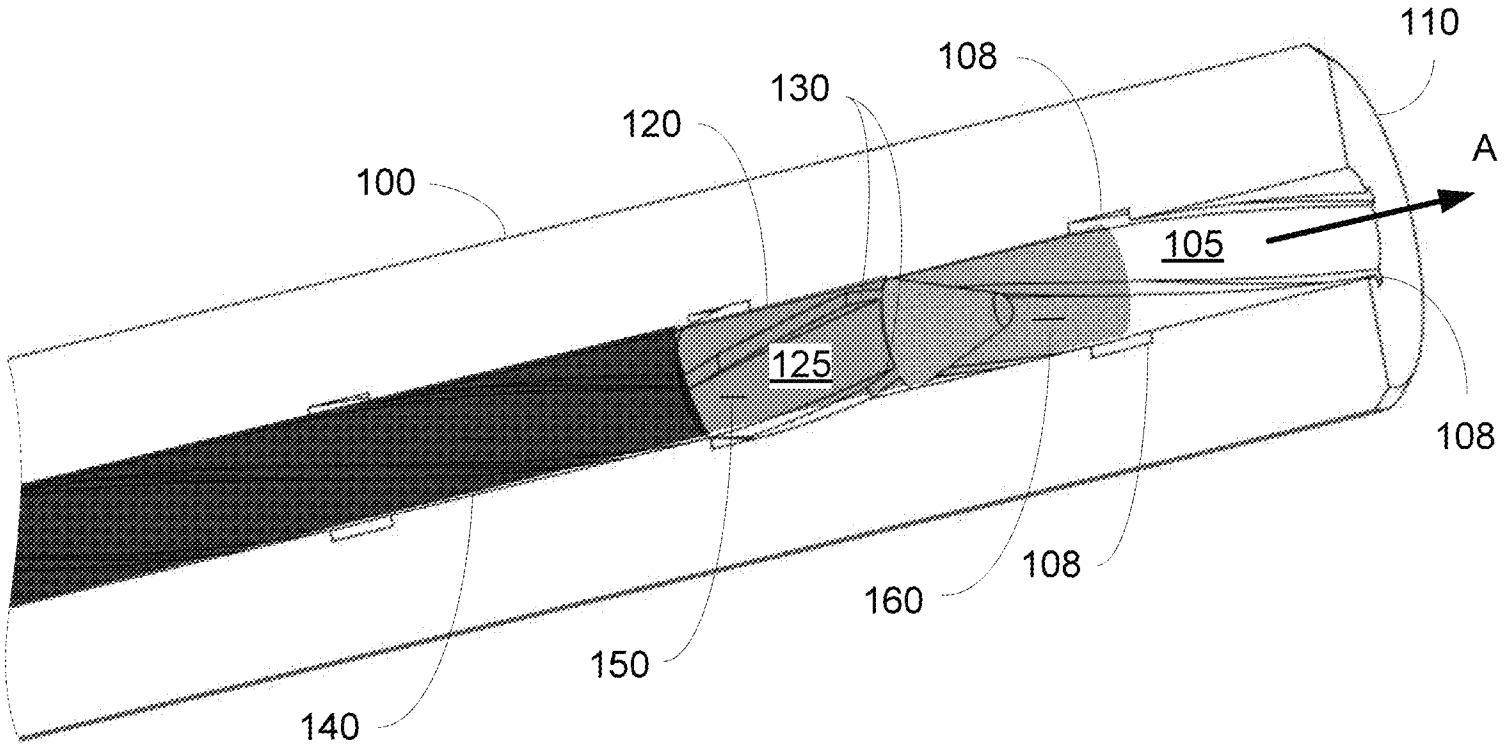
FIG. 1 is a side-perspective view of a bullet being fired in a barrel of the prior art.

The present invention provides a barrel for use in a firearm that improves the accuracy of both sub-sonic and super-sonic projectiles fired from the barrel. The barrel improves the sealing and possible mass imbalance of the obturated bullet due to smearing, erosion, or inconsistencies in each of the bullet lands and in the obturated bullet body. The barrel stabilizes the transitional flight dynamics as the bullet leaves the end of the barrel at the muzzle. The trans-sonic and subsonic flight characteristics of the bullet are also improved by a more aerodynamic surface along the body of the bullet and by an angled sidewall on the trailing edge bullet land.

A firearm barrel is configured for a particular cartridge which may be a rifle or a pistol cartridge. The barrel bore is sized to accept and engage the bullet of the cartridge and the barrel chamber is configured to accept the cartridge body shape. The firearm barrel has a central bore running from the barrel chamber, thru the body of the barrel, and exiting the barrel at the muzzle. The barrel chamber is as concentric and colinear with the barrel bore as manufacturing tolerances allow. The barrel bore has multiple equally spaced rifles, also called rifling grooves, cut into the bore sidewall. The barrel bore then has a diameter down the length of the bore and the barrel has a rifled diameter measured at the bottom of each rifling groove. The rifles spiral around the bore at a constant rate or twist. The rifling diameter is typically .0002 below the nominal diameter of the bullet within the cartridge. Typically, the depth of each barrel rifling is .003 to .005 inch into the barrel bore which results in a rifling diameter of approximately .006 to .010 inch larger than the barrel bore. In a common prior art configuration, the barrel rifling is .004 inch into the barrel bore, and the rifling diameter is .008 inch.

When the propellant, or gunpowder, within the cartridge is ignited, the cartridge bullet is forced from the cartridge and into the bore of the barrel by the propellant pressure. The bullet body is initially larger than the barrel bore minor diameter. The bullet is obturated by the barrel bore wherein the diameter of the bullet body is reduced to the barrel bore diameter, the bullet increases in length slightly, and lands are formed or swaged upon the bullet body corresponding to the rifling grooves in the barrel. The lands swaged upon the bullet engage in the rifling groves and the bullet is spun within the bore. Distortion of the lands on the bullet body, wherein the bullet does not rotate in sequence with the spiraling rifling of the bore during obturation, is called smearing. As defined herein, the bullet body is that portion of the bullet outer surface that engages the barrel bore and rifling grooves.

The obturation of the bullet is a quick, violent, and often imperfect process. The bullet lands may be imperfectly formed as the bullet begins to spin in the bore, the base of the bullet may be distorted or non-symmetrical about the barrel bore axis, and the mass distribution of the obturated bullet about the central axis of the bullet may be mass unbalanced. Stated another way, the lands of the bullet may smear of not fully form, the bullet base may not obturate evenly, and the bullet may have more or less material and mass at some points around the obturated bullet body than at others.

As depicted in FIG. 1, a cartridge is fired in a 4 groove barrel 100 of the prior art. FIG. 1 is a cutaway of the prior art barrel 100 at the muzzle end 110. When the propellant in the cartridge is ignited, the bullet 120 is obturated or swaged into the prior art barrel, lands 130 are formed on the bullet body, and the body 125 of the bullet 120 is somewhat elongated as the bullet is swaged into the barrel. The propellant pressure, depicted in shading 140, forces the bullet 120 down the barrel bore 105. The lands 130 formed upon the bullet body 125 engage within the spiral rifling 108 of the barrel bore 105 and the bullet 120 is spun as it moves forward within the bore 105 in the direction of Arrow "A". In this illustrative example, the depth of the prior art barrel rifling is at .004 inch and results in the lands formed upon the bullet being .004 inch proud of the bullet body. The displaced metal of the obturated bullet body and lands can make a poor seal with the barrel bore and deep rifling.

There are generally two types of bullet designs, flat base bullets and boat tail bullets. The ballistic coefficient "BC" of a bullet is a measure of the bullets ability to overcome air resistance in flight. Stated another way, it's the ratio of the bullet's sectional density to its coefficient of form. In short, a high ballistic coefficient is indicative of a rounds ability to resist drag. When a bullet has an initial sub-sonic velocity when leaving the barrel, the ability of the bullet to resist drag and therefore resist slowing in velocity, becomes more critical. Boat tail bullets generally have a higher ballistic coefficient when flying thru the air than blunt base or flat base bullets. Stated another way, boat tail bullets are more streamlined in flight and less affected by air resistance. Flat base bullets may do a better job at sealing the hot propellant gases within the barrel bore behind the obturated bullet, however flight trajectory precision is generally poor. When boat tail bullets are employed, the hot propellant gases are more likely to interfere with the bullet obturation process and cause the bullet to be overtaken and surrounded by the hot propellant gases within the bore. The hot propellant gases cause side erosion on the bullet body and lands. This erosion may cause a mass imbalance on the obturated bullet, destabilize the flight of the bullet thru the air, and adversely affect the precision of the flight trajectory of the bullet.

As further depicted in FIG. 1, the hot propellant pressure is depicted by shading 140. Propellant gases engulfing the boat tail bullet within the bore are depicted by shading 150. Finally, propellant gases which have passed by the boat tail bullet are depicted by shading 160. The propellant gases engulfing the boat tail bullet erode the bullet body and lands adversely affecting the mass symmetry and the geometric symmetry of the bullet about the barrel bore axis and the axis of spin of the bullet.

Figure 2:
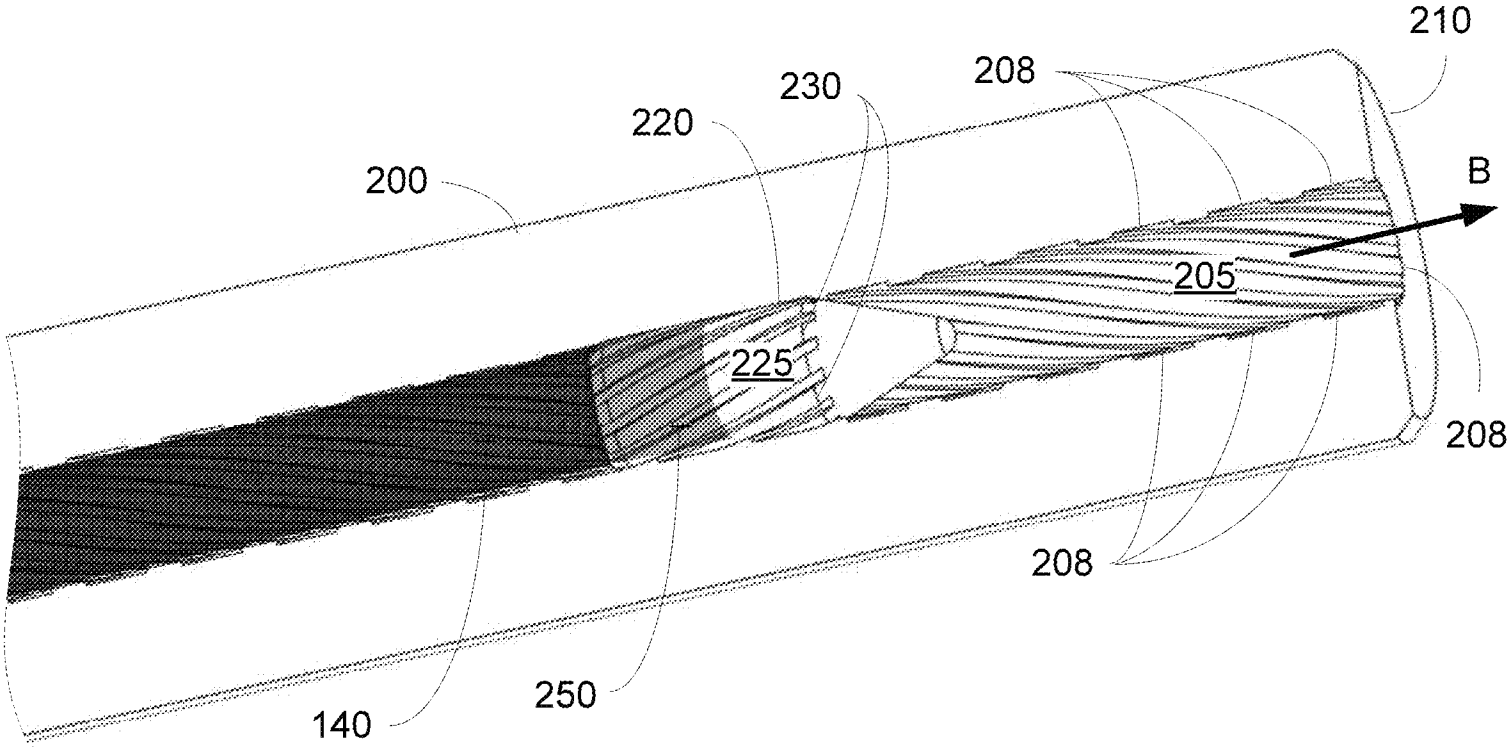
FIG. 2 is a side-perspective view of a bullet being fired in a barrel of the present invention.

As depicted in FIG. 2, in a first embodiment of the present invention, a cartridge is fired in a 12 groove barrel of the present invention. FIG. 2 is a cutaway of the barrel 200 at the muzzle end 210. The propellant forces the bullet 220 down the barrel bore 205 in the direction of Arrow "B", and the bullet 200 is obturated or swaged into the barrel bore 205, lands 230 are formed on the bullet body 225, and the body of the bullet is somewhat elongated as the bullet 220 is swaged into the barrel 200.

In the 12 groove illustrative embodiment of FIG. 2, the depth of the barrel rifling 208 is at .0025 inch and results in the lands 230 of the bullet body 225 being .0025 inch tall. The hot propellant pressure is depicted by shading 140. Propellant gases engulfing the boat tail bullet within the bore are depicted by shading 250. The displaced metal of the bullet body 225 and relative shallow height lands 230 formed upon the bullet body more easily form a seal within the barrel bore 205 and shallow rifling 208. As the bullet 220 moves forward within the barrel bore 205, the high groove count of the barrel bore and resulting high land 230 count upon the bullet 220 more easily engage the spiral rifled 208 barrel bore without smearing of the bullet lands 230. The resulting displaced metal of the obturated bullet body and high but shallow height land count form a superior seal with the barrel bore and shallow barrel rifling.

Figure 3:
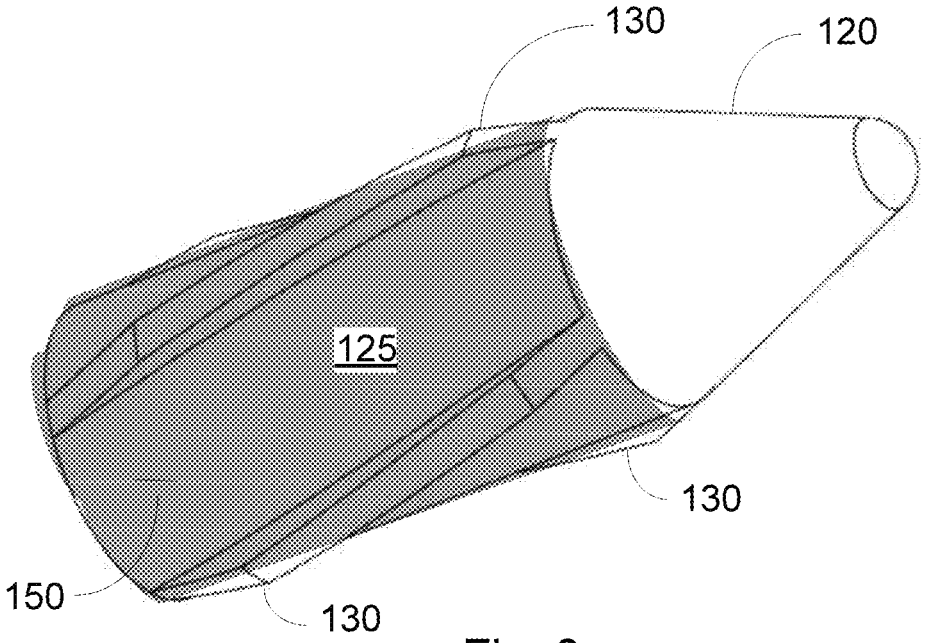
FIG. 3 is a side-perspective view of a bullet fired from a barrel of the prior art.
Figure 4:
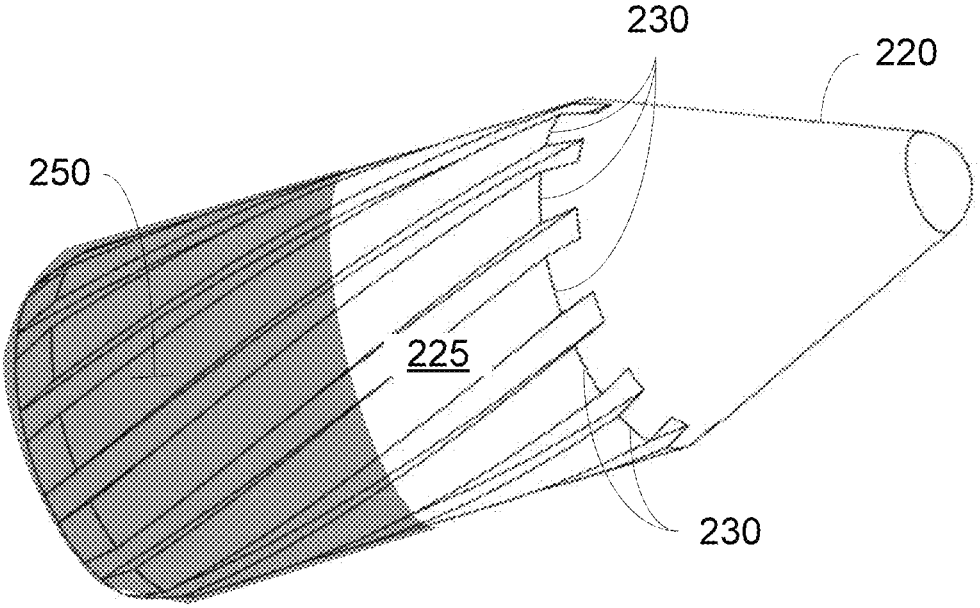
FIG. 4 is a side-perspective view of a bullet fired from the barrel of the present invention.

As depicted in FIG. 3, a sub-sonic bullet 120 fired from a 4 groove barrel of the prior art has erosion all along the body of the bullet 125. The erosion is depicted by shaded area 150. In flight, the bullet land 130 and bullet body 125 erosion causes a dynamic imbalance to the spinning mass of the bullet. The poorly formed lands may also cause turbulence and buffeting as the bullet spins thru the air. As depicted in FIG. 4, a sub-sonic bullet 220 fired from a 12 groove barrel of the present invention has a minimum of erosion 250 at the base of the bullet body 225 and bullet lands 230.

In flight, any dynamic imbalance to the spinning mass of the bullet is minimized because the uniformly obturated bullet mass is more uniform about the axis of spin of the bullet. The 12 rifle groove barrel of this exemplary embodiment of the present invention provides at least a 50% less felt effect from inconsistencies in the land to land dimension and mass of the bullet in flight. Stated another way, any inconsistencies in the height or width of a single land of the bullet of the present invention has a 1/12 proportional effect upon the bullet flight precision as compared to the 1/4 proportional effect of an inconsistency in a land in a bullet fired from a 4 groove barrel of the prior art. In the present invention, the multiple shallow lands (12 lands) of the bullet are well formed and the bullet experiences less dynamic imbalance, and experiences less turbulence and buffeting from the lands engaging the incoming air stream. As defined herein, turbulence is violent or unsteady movement of air about the bullet body. As defined herein, buffeting is an irregular oscillation of the bullet caused by turbulence.

FIGS. 1-2 depict the ballistics of the bullet internal to the barrel. FIGS. 3-4 depict the ballistics of the bullet in flight. The transitional ballistics, the ballistics as the bullet just leaves the barrel are also key to the precision of the flight trajectory and are more elusive. While conventional rifling of 4 to 6 grooves at approximately .004 deep works well with super-sonic ammunition, in sub-sonic ammunition the bullet flight trajectory with conventional rifling is far less precise. The transitional ballistics of the sub-sonic bullet have more effect on the flight trajectory precision than bullets leaving a barrel at super-sonic velocities.

Figure 5:
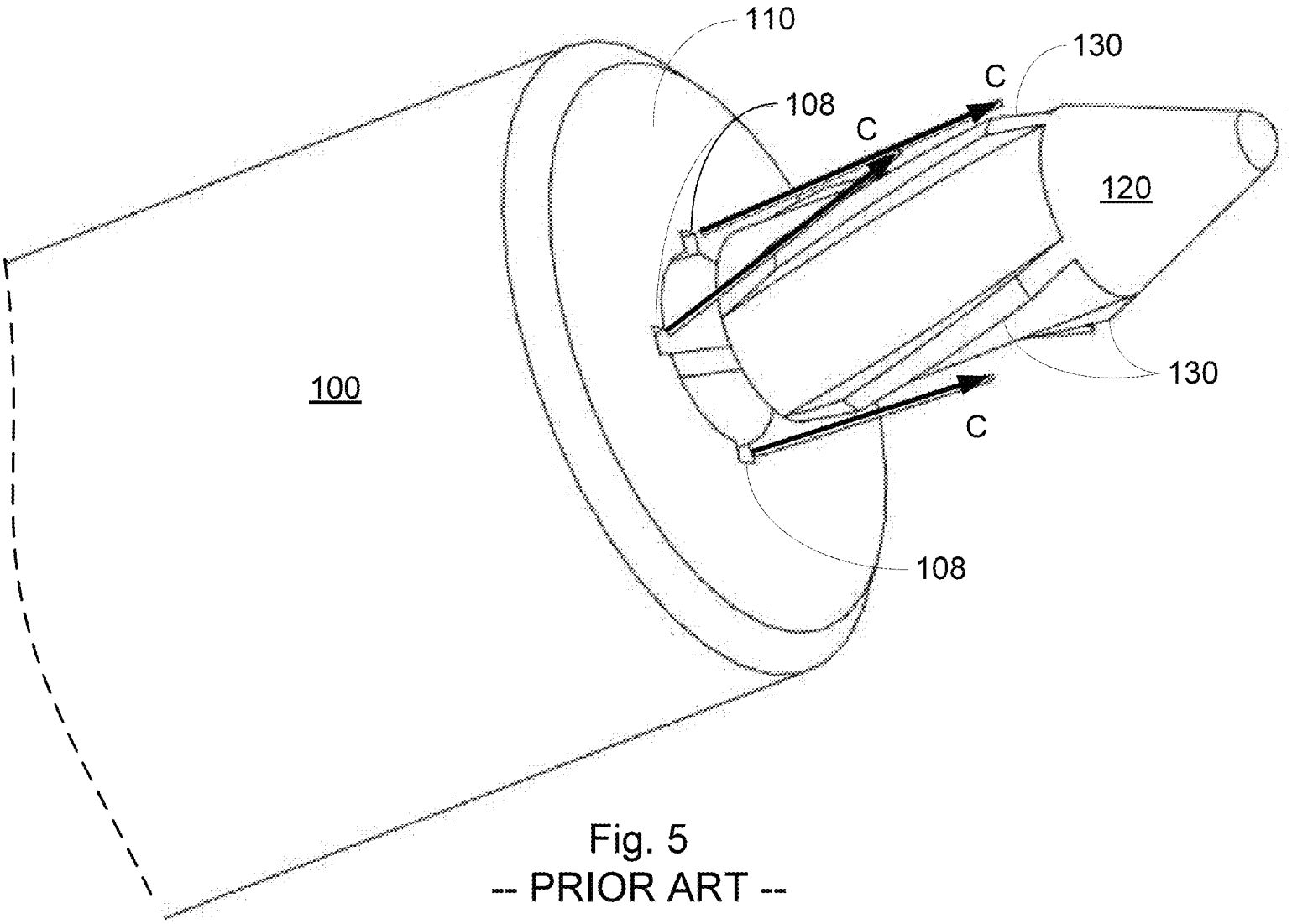
FIG. 5 is a side-perspective view of a bullet exiting a barrel of the prior art.

As depicted in FIG. 5, a sub-sonic bullet 120 is leaving the 4 groove barrel 100 of the prior art at the muzzle 110. The bullet 120 has 4 lands 130 formed thereon, and at a relatively high .004 inch proud of the bullet body. Jets of propellant pressure emit from each groove 108 opening and are depicted by large Arrows "C". As will be appreciated by those skilled in the art, propellant pressure vents all about the base of the bullet in addition too via the groove 108 openings. The base of the bullet must be uniformly obturated and present a consistent surface to the venting propellant pressure about the bore axis of the bullet. Any discrepancy in the base of the obturated bullet will result in a large disturbance to the flight trajectory of the bullet. Any discrepancy in one of the formed lands 130 on the bullet will result in a large disturbance to the flight trajectory of the bullet.

Figure 6:
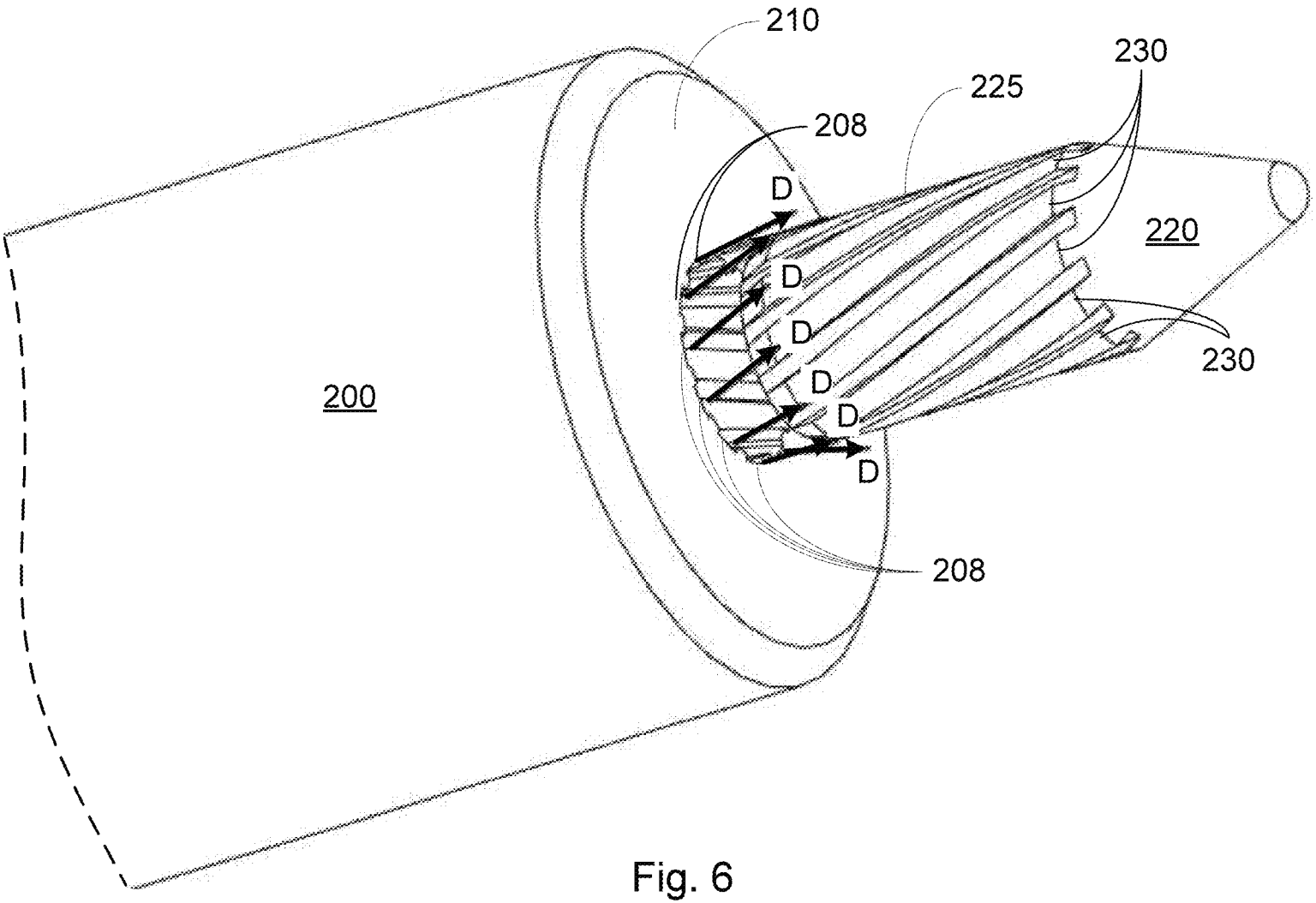
FIG. 6 is a side-perspective view of a bullet exiting the barrel of the present invention.

Another embodiment of the present invention is depicted in FIG. 6, wherein a bullet 220 is leaving the 12 groove barrel 200 of the present invention. The bullet 220 has 12 lands 230 formed thereon and at relatively shallow .0025 inch proud of the bullet body 225. Jets of propellant pressure emit from each groove 208 opening and are depicted by small Arrows "D". Because of the high but shallow groove 208 count, the base of the bullet is uniformly obturated about the axis of the barrel bore and presents a consistent and symmetrical surface to the venting propellant pressure about the bore axis of the bullet 220. Any discrepancy in one of the 12 lands 230 formed upon the bullet will result in a proportionately smaller disturbance to the flight trajectory of the bullet. Hence the precision of the bullet flight trajectory with the barrel of the present invention will be higher. Stated another way, in reference to the bullet lands, any inconsistency in any one bullet land formed via the higher number and shallow groove count of the barrel of the present invention has at least a 50% less disturbance to the flight trajectory of the bullet as it leaves the barrel. In reference to the bullet base, the consistent lands and grooves in the bullet base fired from the barrel of the present invention results in less disturbance to the flight trajectory of the bullet.

Figure 7:
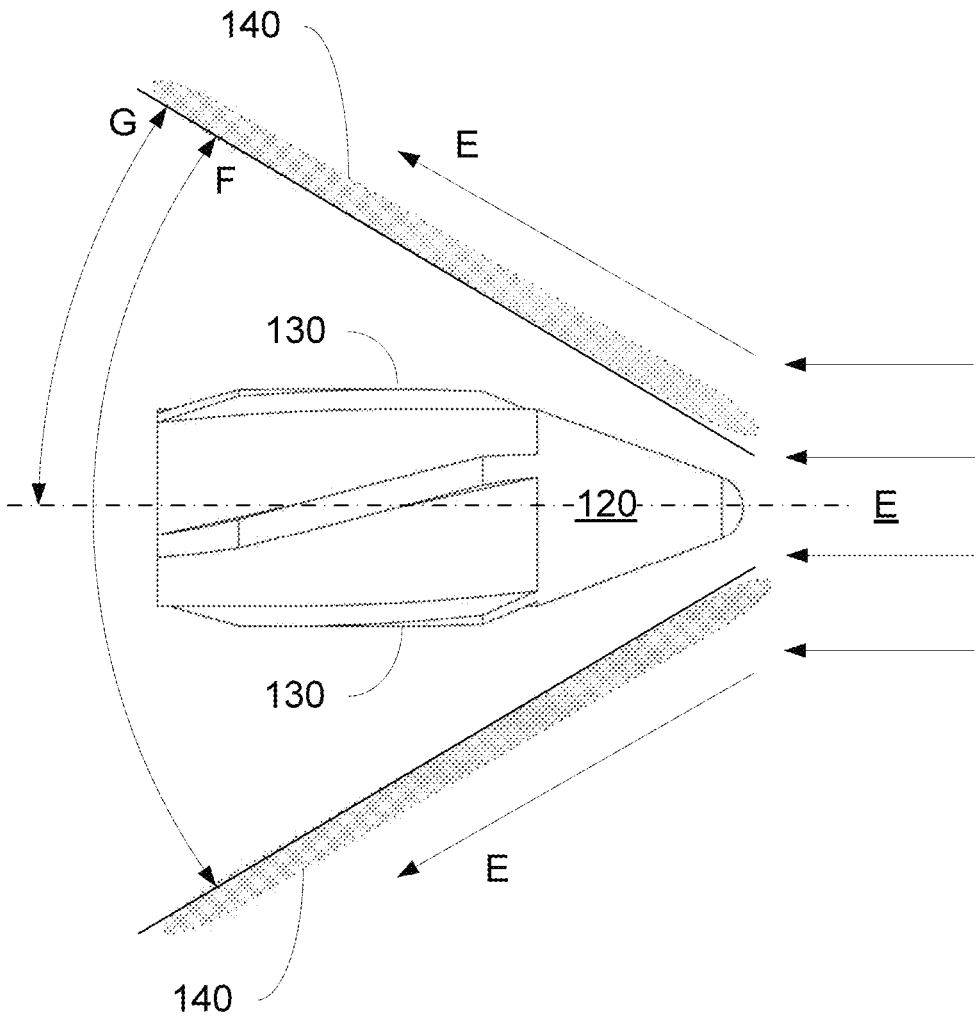
FIG. 7 is side view of a super-sonic bullet fired from a barrel of the prior art.

Another important regime of bullet flight path precision ballistics is the flight of the bullet thru the air of the atmosphere. FIG. 7 depicts a super-sonic bullet 120 in flight thru the atmosphere depicted by Arrows "E". A shockwave, depicted by shaded area 140, forms on the bullet nose and shock cone depicted by Arrow "F" extends back at an angle away from the bullet 120 nose and lands 130. As the shockwave shears away from the bullet, the configuration and height of the bullet lands 130 have little effect on the bullet 120 flight trajectory precision as the bullet body and lands are partially shielded by the shockwave from the incoming super-sonic air blast. One half of the angle of the shock cone as depicted by Arrow "G" may be used to calculate the speed of the bullet with the formula: Mach=1/sin(G). As the bullet slows, the angle of the shock cone will become larger until the bullet slows sufficiently for a normal shock to form at the forward portion of the bullet.

Figure 8:
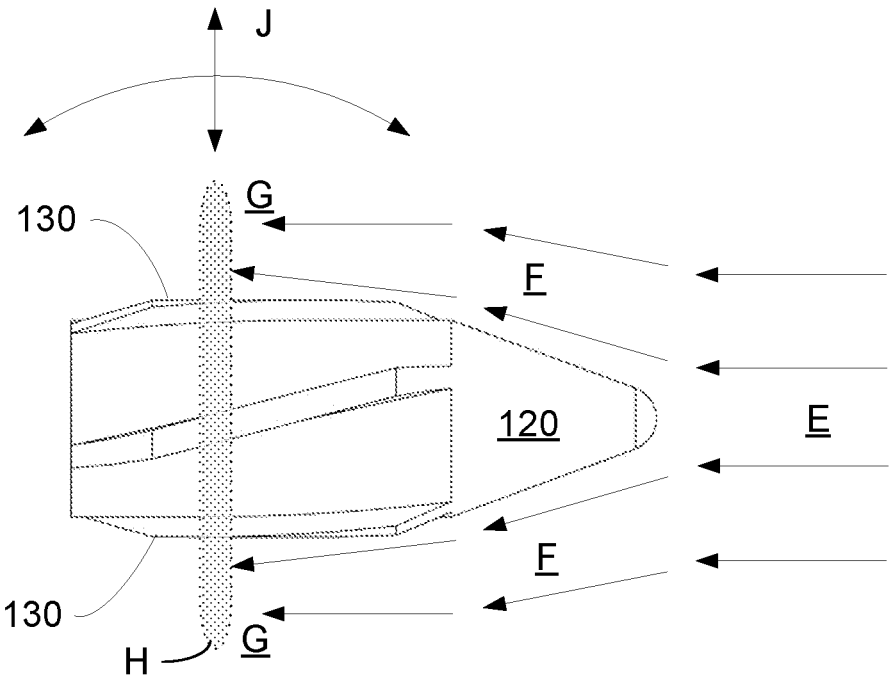
FIG. 8 is side view of a trans-sonic bullet fired from a barrel of the prior art.

FIG. 8 depicts a 4 land bullet 120 traveling at just below sonic velocity in the range of mach .9 or 9/10$^{th}$ the speed of sound. In the prior art, the speed range of .8 to 1.2 mach is referred to as the transonic regime. Transonic flow is air flowing around an object at a speed that generates regions of both subsonic and supersonic airflow around that object. In this illustrative example, a bullet has been shot from a 4 groove firearm barrel at sub-sonic velocity and is flying thru the atmosphere depicted by Arrows "E" at 1,000 feet per second. The air speed over the nose of the bullet is initially sub-sonic. In the region "F" in FIG. 8, the air is accelerating to go around the bullet body. At "G" the incoming air traveling around the bullet reaches sonic velocity and a normal shock wave forms around the body of the bullet represented by shaded area "H". The turbulence of the normal shock wave buffets the relatively high land 130 of the 4 land bullet 120 of the prior art. The buffeting and magnitude of buffeting is represented by Arrows "J". As will be appreciated by those skilled in the art, the normal shock wave will move down the bullet body as the bullet slows in flight until the air flowing across the bullet goes fully subsonic across the whole bullet body.

Figure 9:
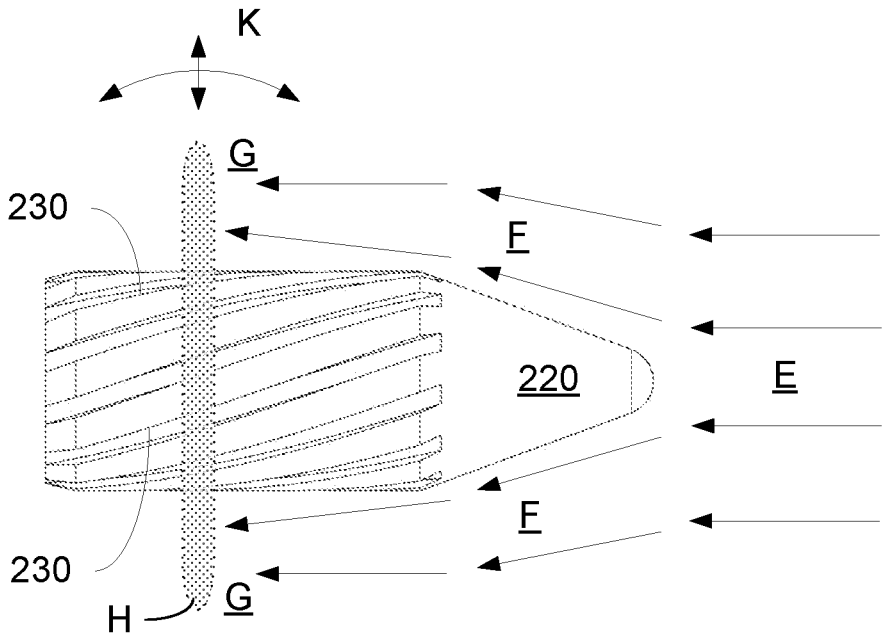
FIG. 9 is side view of a trans-sonic bullet fired from the barrel of the present invention.

In another alternative embodiment of the present invention, FIG. 9 depicts a 12 land bullet 220 fired from the barrel of the present invention. In this illustrative embodiment, a 12 land bullet has been shot from the firearm barrel of the present invention at sub-sonic velocity and is flying thru the atmosphere "E" at 1,000 feet per second. The air speed over the nose of the bullet is initially sub-sonic. In the region "F" in FIG. 9, the air speed is accelerating to go around the bullet body. At "G" the air reaches sonic velocity and a normal shock wave forms around the body of the bullet represented by shaded area "H". The normal shock buffets the relatively low height land 230 of the 12 land bullet 220 to a lesser effect and in a more uniform pattern. The low height land buffeting and the resulting low magnitude of buffeting is depicted by Arrows "K".

In the bullet 120 fired from the prior art barrel of FIG. 8, the bullet lands make up far less than 50% of the circumference of the bullet body. The remainder of the circumference is made up of the bullet body surface as formed by the barrel bore. In the sub-sonic bullet 220 of FIG. 9, the bullet lands form a much higher percentage of the circumference of the bullet body. In the 12 land illustrative example of FIG. 9 fired from the barrel of the present invention, more than 2/3 of the bullet circumference is made up of bullet lands. The remaining circumference is the groves in the bullet as formed by the barrel bore. Stated another way, the bullet 120 as fired from the prior art barrel presents to the incoming air blast and normal shock wave a bullet body diameter (more than 2/3 of the bullet circumference), but with 4 high lands 130 or ribs extending out from the bullet body. A bullet 220 fired from the barrel of the present invention presents to the incoming air blast and normal shock wave 12 lands 230 (more than 2/3 of the bullet circumference) with 12 shallow grooves then carved into the bullet body. Stated another way, the lands of a bullet fired from a barrel of the present invention are more numerous and make up 2/3 of the bullet circumference, the lands in total present a more uniform outer bullet surface and with only shallow grooves encompassing 1/3 of the bullet circumference therein. The normal shock wave "H" formed as the air accelerates around the bullet has at least a 50% less felt effect upon the shallow and more numerous lands of a bullet fired from a barrel of the present invention.

As will be appreciated by those skilled in the art, we reach a tipping point, or flip in flight dynamics of the bullet as the land surface exceeds the groove surface of the bullet. In bullet flight, the surface presented to the incoming atmosphere from a bullet body with high lands of the prior art, to a primarily bullet outer surface of lands but with only shallow groves in the present invention. In regard to the bullet in flight, due to the greater surface area of the riffling peaks vs valleys of the present invention in contrast to a prior art 4-6 groove riffled bullet, the air in the valleys creates a shielded pocket, thus creating high pressure bridge or cushion of air that lies in the grooves that has an independent air flow from the air traveling around the outer bullet land peaks. In flight, the incoming atmosphere or air blast traveling along the outside surface of the bullet, fired from the barrel of the present invention, rides along the land peaks and spans across the grooves. The air blast rides across the outer diameter of the bullet without infiltrating the grooves and creating turbulence and associated buffeting of the bullet flight trajectory. A bullet fired from the barrel of the present invention presents greater than 66% of the bullet body circumference, and subsequently outer surface of the bullet body, as consistent raised lands to the incoming air blast. The remaining bullet body circumference being made up by the shallow grooves. As will be appreciated by those skilled in the art, in the barrel of the present invention the fired bullet circumference land to groove ratio may be between 50% to 90% land circumference for differing riffling counts and barrel designs of the present invention.

Figure 10:
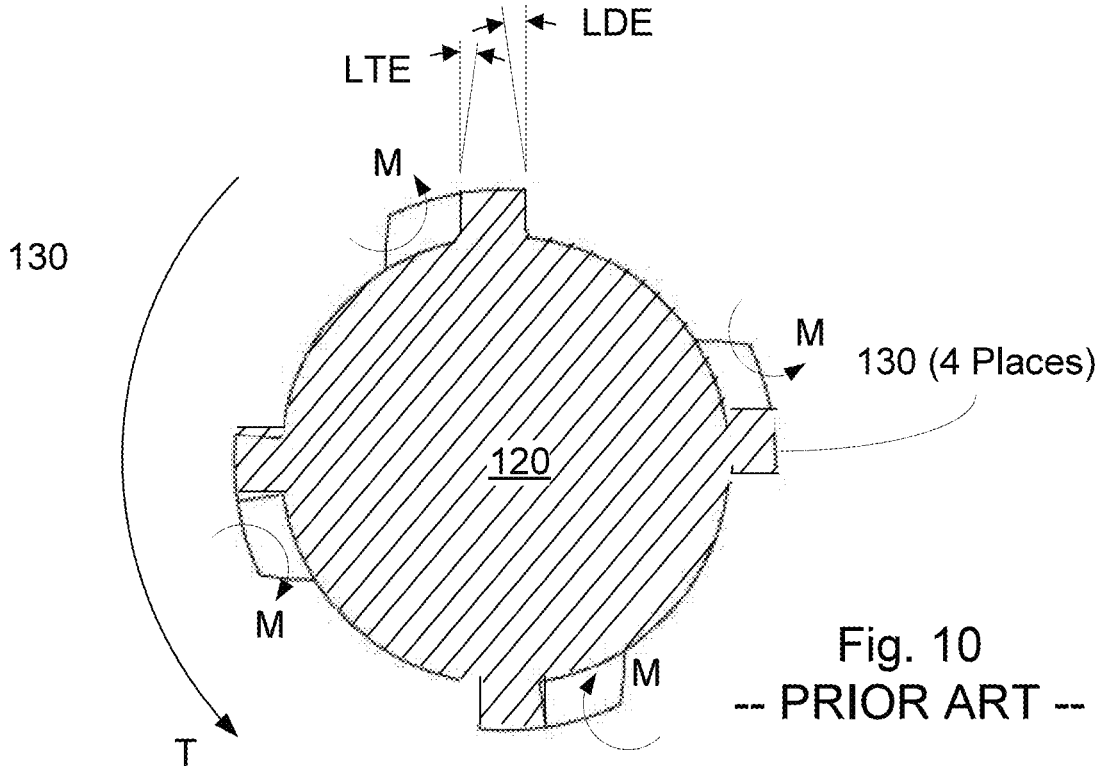
FIG. 10 is a cross-sectional view of a bullet fired from a barrel of the prior art.

A cross section of a bullet 120 fired from the 4 groove barrel of the prior art is depicted in FIG. 10. As will be appreciated by those skilled in the art, each groove of the barrel has a sidewall defining each end of the groove. As defined herein, a reference edge is defined wherein each groove sidewall is parallel to the opposing sidewall of the same barrel groove. This parallel reference edge at each barrel sidewall forms a convenient edge to measure the barrel groove sidewall angle. Correspondingly, the obturated bullet 120 will have a reference edge to which the bullet land 130 angle may be defined. In the prior art barrel, the grove sidewalls are parallel or are at a shallow obtuse angle to one another. Each barrel groove has a driven edge which engages the bullet and forces the bullet to spin down the barrel bore at the twist rate of the barrel. Each barrel groove also has a grove trailing edge which forms the opposing face of the groove. The angle between the sidewalls of the barrel grooves and the reference edge at each end of the groove is always 0 degrees or greater. Correspondingly, a bullet 120 fired from a 4 groove barrel of the prior art has a land 130 driven edge angle "LDE" with the reference edge of the bullet, and a land trailing edge angle "LTE" with the opposing reference edge as depicted in FIG. 10.

In the barrel configurations of the prior art, the LDE angle and the LTE angle swaged upon the bullet are the same and between 0 degrees to 5 degrees to the reference edges of the bullet. Correspondingly, a bullet fired from the barrel of the prior art has a bullet land which is obturated or swaged upon it which is narrow at the outer surface of the land and is parallel or tapers to a wider base at the bullet body.

As will be appreciated to those skilled in the art, as a subsonic bullet is traveling thru the air, the bullet is initially spinning at a rate corresponding to the twist rate of the barrel at the bullet velocity. The bullet spin direction is depicted by Arrow "T". As the bullet travels downrange, the forward velocity of the bullet slows at a rate faster than the spin rate of the bullet slows. Stated another way, the air impacting the front of the fired bullet slows the bullet forward velocity far faster than the spin rate of the bullet slows. As the sub-sonic bullet travels downrange, the bullet is spinning faster then the forward velocity of the bullet justifies and the lands of the bullet effectively auger or screw thru the incoming air blast. The angle of the land trailing edge sidewall of the bullet becomes more critical to the bullet flight path precision as the incoming air blast is encountering the land trailing edge and not the land driven edge in the overspinning bullet.

As further depicted in FIG. 10, in a bullet 120 fired from the left twist prior art barrel, the angle between the reference edge and the land trailing edge "LTE" is at a blunt angle to the incoming air which the bullet land is augering thru. The angle between the reference edge and the land driven edge "LTE" is also depicted. As depicted in FIG. 10, by Arrows "M" the blunt land trailing edge angle "LTE" causes turbulence to a bullet fired from the barrel of the prior art. This turbulence at the land trailing edge in the bullet fired from the prior art barrel buffets the bullet and adversely effects the bullet flight trajectory precision.

Figure 11:
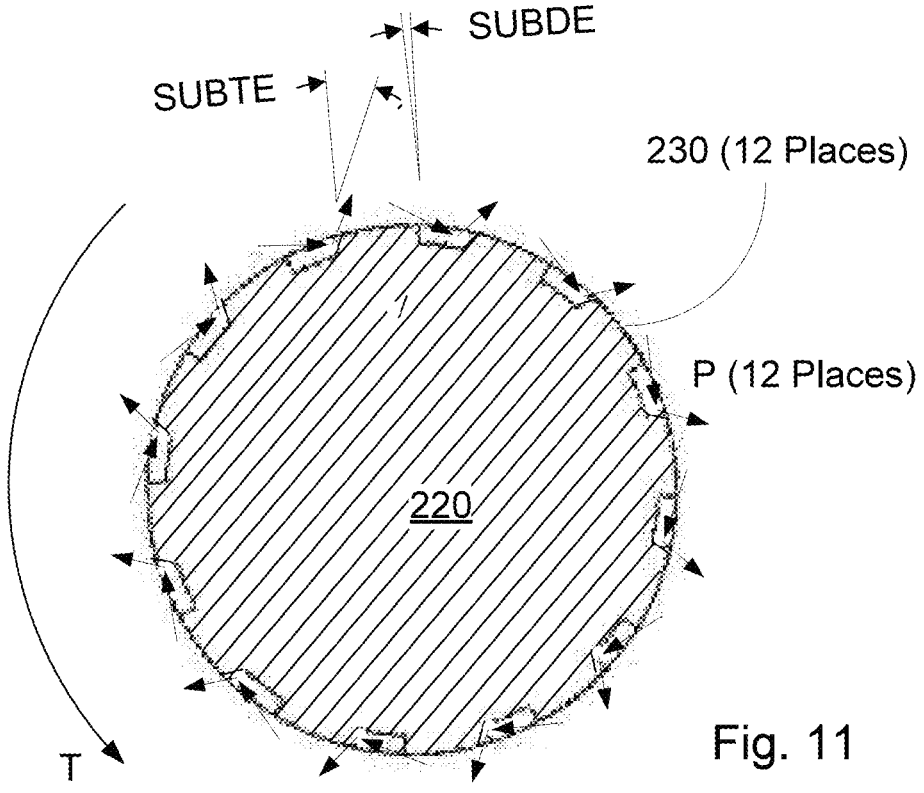
FIG. 11 is a cross-sectional view of a bullet fired from the barrel of the present invention.

Another alternative embodiment of the present invention is presented in FIG. 11, wherein a cross section of a sub-sonic bullet 220 fired from a left twist 12 groove barrel of the present invention is depicted. The bullet 220 spin direction is depicted by Arrow "T". In this embodiment, the sub-sonic driven edge of the bullet land and the sub-sonic trailing edge of the bullet land are not at the same angle relative the barrel groove base. The barrel of the present invention has groove faces which are between parallel to 5 degrees obtuse from the reference groove face at the driving edge of the barrel groove. This results in the obturated bullet fired from the barrel of the present invention to have a sub-sonic driven edge land of between 0 to 5 degrees as depicted by angle "SUBDE" in FIG. 11. The sharp angle of the sub-sonic driven edge land prevents smearing of the lands as the bullet is fired and obturated within in barrel. However, in this embodiment of the present invention, the trailing edge groove face within the barrel is always at a more obtuse angle between parallel to 20 degrees obtuse from the reference edge opposing at the trailing face of the barrel groove. This results in an obturated bullet fired from the barrel of the present invention to have a sub-sonic trailing edge land at an angle "SUBTE" between 0 to 20 degrees to the reference edge as depicted in FIG. 11.

As depicted by Arrows "P" in FIG. 11 in flight the incoming air blast is encountering the sub-sonic land trailing edge of the bullet as it overspins or augers into the incoming air blast. The angled sub-sonic land trailing edge "SUBTE" directs the incoming air smoothly out and away from the bullet body and does not create the amount of turbulence and associated buffeting of the bullet flight trajectory generated by the more blunt land trailing edge angle "LTE" of the prior art barrel and fired bullet of FIG. 10. The flight trajectory precision of the sub-sonic bullet fired form the barrel of the present invention is thereby improved by the angled sub-sonic land trailing edge.

The exemplary embodiments of the invention herein all depict a 12 groove barrel. As will appreciated by those skilled in the art, any barrel with 8 or more grooves may benefit from the present invention.

While there has been shown a preferred embodiment of the present invention, it is to be understood that certain changes may be made in the forms and arrangement of the elements of the sub-sonic high precision firearm barrel without departing from the underlying spirit, scope, and essential characteristics of the invention. The present embodiment is therefore, to be considered as merely illustrative and not restrictive, the scope of the invention being indicated by the claims rather than the foregoing description, and all changes which come within the meaning and range of equivalence of the claims are therefore intended to be embraced therein.

What is claimed is:

1. A barrel for use in a firearm, the barrel having a central axis and a central bore formed around the central axis, the central bore having a bore diameter, the barrel having a chamber for receiving a cartridge therein, the chamber configured to receive a cylindrical cartridge case with a bullet engaged within the cartridge case, the bullet having a nominal bullet diameter, and the cartridge case containing a propellant, the propellant producing a propellant pressure upon ignition of the propellant, the barrel further comprising:

the barrel having a plurality of rifling grooves within the bore, the outer diameter of the grooves defining a groove diameter, the groove diameter being within .0003 inch of the nominal bullet diameter;

the barrel having at least 8 rifled grooves;

each of the plurality of rifling grooves having a sidewall formed from the bore diameter to the groove diameter, wherein the sidewalls formed are substantially parallel and the depth of each of the rifling grooves is shallow;

wherein the rifled grooves have a twist angle to spin the bullet as the bullet is forced down the bore, the twist angle formed between the groove and the central axis of the bore, the groove twist angle imparting a twist rate upon the bullet;

wherein upon ignition of the propellant, the bullet is forced by propellant pressure out of the cartridge case and into the rifled bore of the barrel, the propellant pressure then forcing the bullet out the end of the barrel at a subsonic velocity;

the bullet being obturated as the bullet is forced down the bore, the plurality of shallow rifling grooves forming a plurality of raised lands upon the bullet, each of the plurality of raised lands formed having a reduced height;

the obturated bullet comprising at least 50% lands formed upon the circumference of the bullet body; and wherein a buffeting effect upon the bullet in flight by a normal shock wave upon the bullet is reduced by the plurality of raised lands and the reduced height of each of the plurality of bullet lands.

2. A barrel for use in a firearm, the barrel having a central axis and a central bore formed around the central axis, the central bore having a bore diameter, the barrel having a chamber for receiving a cartridge therein, the chamber configured to receive a cylindrical cartridge case with a bullet engaged within the cartridge case, the bullet having a nominal bullet diameter, and the cartridge case containing a propellant, the propellant producing a propellant pressure upon ignition of the propellant, the barrel further comprising:

the barrel having a plurality of rifling grooves within the bore, the outer diameter of the grooves defining a groove diameter, the groove diameter being within .0003 inch of the nominal bullet diameter;

the barrel having at least 8 rifled grooves;

each of the plurality of rifling grooves having sidewalls formed from the bore diameter to the groove diameter, each rifling groove having a driven side and a trailing side and the depth of each of the rifling grooves is shallow;

wherein the rifled grooves have a twist angle to spin the bullet as the bullet is forced down the bore, the twist angle formed between the groove and the central axis of the bore, the groove twist angle imparting a twist rate upon the bullet;

wherein upon ignition of the propellant, the bullet is forced by propellant pressure out of the cartridge case and into the rifled bore of the barrel, the propellant pressure then forcing the bullet out the end of the barrel at a subsonic velocity; and the bullet being obturated as the bullet is forced down the bore, the plurality of barrel grooves forming a plurality of raised lands upon the bullet, the raised lands formed upon the bullet having a driven edge land, and a trailing edge land; and wherein the driven edge of the bullet land is 0 to 5 degrees to the reference edge and the trailing edge of the bullet land is between 0 and 20 degrees to the reference edge, and a buffeting effect by a normal shock wave upon the bullet in flight by turbulence across the trailing edge bullet land is reduced.

3. A barrel for use in a firearm, the barrel having a central axis and a central bore formed around the central axis, the central bore having a bore diameter, the barrel having a chamber for receiving a cartridge therein, the chamber configured to receive a cylindrical cartridge case with a bullet engaged within the cartridge case, the bullet having a nominal bullet diameter, and the cartridge case containing a propellant, the propellant producing a propellant pressure upon ignition of the propellant, the barrel further comprising:

the barrel having a plurality of rifling grooves within the bore, the outer diameter of the grooves defining a groove diameter, the groove diameter being within .0003 inch of the nominal bullet diameter;

the barrel having at least 8 rifled grooves;

each of the plurality of rifling grooves having a sidewall formed from the bore diameter to the groove diameter, wherein the sidewalls formed are substantially parallel and the depth of each of the rifling grooves is shallow;

wherein the rifled grooves have a twist angle to spin the bullet as the bullet is forced down the bore, the twist angle formed between the groove and the central axis of the bore, the groove twist angle imparting a twist rate upon the bullet;

wherein upon ignition of the propellant, the bullet is forced by propellant pressure out of the cartridge case and into the rifled bore of the barrel, the propellant pressure then forcing the bullet out the end of the barrel at a subsonic velocity; and wherein a buffeting effect of the propellant pressure upon the bullet from an imperfection in any one rifling groove is reduced by at least 50% and a buffeting of the bullet as the bullet exits the barrel and transitions to flight is reduced.

4. A barrel for use in a firearm, the barrel having a central axis and a central bore formed around the central axis, the central bore having a bore diameter, the barrel having a chamber for receiving a cartridge therein, the chamber configured to receive a cylindrical cartridge case with a bullet engaged within the cartridge case, the bullet having a nominal bullet diameter, and the cartridge case containing a propellant, the propellant producing a propellant pressure upon ignition of the propellant, the barrel further comprising:

the barrel having a plurality of rifling grooves within the bore, the outer diameter of the grooves defining a groove diameter, the groove diameter being within .0003 inch of the nominal bullet diameter;

the barrel having at least 8 rifled grooves;

each of the plurality of rifling grooves having a sidewall formed from the bore diameter to the groove diameter, wherein the sidewalls formed are substantially parallel and the depth of each of the rifling grooves is shallow;

wherein the rifled grooves have a twist angle to spin the bullet as the bullet is forced down the bore, the twist angle formed between the groove and the central axis of the bore, the groove twist angle imparting a twist rate upon the bullet;

wherein upon ignition of the propellant, the bullet is forced by propellant pressure out of the cartridge case and into the rifled bore of the barrel, the propellant pressure then forcing the bullet out the end of the barrel at a subsonic velocity;

the bullet being obturated as the bullet is forced down the bore, the plurality of barrel grooves forming a plurality of raised lands upon the bullet; and wherein as the bullet is forced down the barrel bore, a sealing of the propellant pressure behind the bullet and between the bullet and barrel bore is improved by the plurality of shallow rifling grooves.

* * * * *